US005251997A

United States Patent [19]

Brock

[11] Patent Number: 5,251,997

[45] Date of Patent: Oct. 12, 1993

[54] EMBEDDABLE PAVING BLOCK INTENDED FOR THE SURFACING OF ROADWAYS AND OTHER AREAS OF GROUND AND THE ROADWAYS OR OTHER AREAS OF GROUND WHICH ARE SURFACED WITH SUCH PAVING BLOCKS

[76] Inventor: Jean-Jacques Brock, Provedroux 12, B - 6690 Vielsalm, Belgium

[21] Appl. No.: 792,282

[22] Filed: Nov. 14, 1991

[30] Foreign Application Priority Data

Nov. 16, 1990 [BE] Belgium ..... 09001078

[51] Int. Cl.[5] ..... E01C 5/00

[52] U.S. Cl. ..... 404/29; 404/34; 404/42

[58] Field of Search ..... 404/291, 32-33, 404/34-36, 40-42

[56] References Cited

U.S. PATENT DOCUMENTS

| | | | |
|---|---|---|---|
| 4,030,729 | 6/1977 | Nathaniel | 404/41 X |
| 4,840,825 | 6/1989 | Aristodimou | 404/41 X |
| 4,875,803 | 10/1989 | Scales | 404/41 X |
| 4,973,505 | 11/1990 | Bielous | 404/32 X |
| 5,046,887 | 9/1991 | Fontana et al. | 404/34 |
| 5,054,957 | 10/1991 | Johnson et al. | 404/41 |
| 5,098,218 | 3/1992 | Reese et al. | 404/41 X |
| 5,133,620 | 7/1992 | Scheiwiller | 404/41 X |

*Primary Examiner*—Kenneth J. Dorner
*Assistant Examiner*—Nancy P. Connolly
*Attorney, Agent, or Firm*—Herbert Dubno; Yuri Kateshov

[57] ABSTRACT

The embeddable paving block intended for surfacing roadways and other areas of ground, of the type including four identical arms disposed at right-angles to one another, each of the arms having shoulders distributed over the lateral faces and the ends of each of these arms, the shoulders being disposed to overlap in the plane of the surfacing the corresponding shoulders on the adjacent blocks in order to prevent the plane from opening up under the effect of any traction and in order to ensure a constant thickness of the joints.

5 Claims, 6 Drawing Sheets

EMBEDDABLE PAVING BLOCK INTENDED FOR THE SURFACING OF ROADWAYS AND OTHER AREAS OF GROUND AND THE ROADWAYS OR OTHER AREAS OF GROUND WHICH ARE SURFACED WITH SUCH PAVING BLOCKS

The present invention relates to the production of surfacings for roadways and other areas approved for the circulation of vehicles and pedestrians or also for pitched embankments, banks, slopes and sea-bordered dikes or water courses, and it relates to an original design of flush-embedded paving blocks which form flush-embedded formations in all directions.

BACKGROUND OF THE INVENTION

There are numerous types of flush-embedded paving blocks which more or less effectively perform the following functions:

break up the smoothness of the contact faces in order to prevent longitudinal and transverse displacement of the paving blocks with respect to one another; provide an enlarged perimeter of the paving blocks and therefore their contact surface area in order to increase the friction and thus the resistance to individual collapse under load; and break up the rectilinearity of the joints in order to prevent them from acting as a hinge in the plane of the surfacing and in order to combat the rutting phenomenon.

However, these three objectives can only be achieved if each paving block is placed in a position where it is impossible for it to move away from its neighbors, which is achieved only by perfect abutment of the whole, ensuring a horizontal transference of load. However, this is not always possible. For example, one can invention areas on roofs, where the thickness and the load are limited and the possibilities of counter-abutment are all the more reduced, or also cycle tracks and other narrow roadways where the extent of the borders is disproportionate to the surface area.

However this may be, any rutting is reflected in traction on the upper or lower surface of the surfacing, according to whether it is situated in the raised zone or the depressed zone of the the ruts.

Known from the document FR-A-2608 is an interlocking paving block which is cruciform in shape and the four arms of which are of the same width, the length of one arm being equal to its width. Such a paving block is only capable of withstanding a thrust stress.

Described in the document EP-A-0 377 460 is a paving block for surfacing an area of ground and which is of square shape, comprising on its lateral surfaces spacers which allow lawn to be positioned between the fitted together paving blocks.

These projections coincide or overlap one another in adjacent paving, blocks according to the size allowed for the lawn. Here there is no question of flush fitment for withstanding thrust or traction stresses.

However, the necessary limitation of the angle of flare of the arms, on plane of excessively reducing the points of connection, means that the flush fitment can no longer be very effective.

OBJECT OF THE INVENTION

An embeddable cruciform paving block is known which is the object of a design filed by the Applicants which, with its four equal and slightly flared arms, already sought to satisfy this entirely unprecedented objective.

The object of the invention is to design an embeddable paving block which by itself is able to contribute to the resistance to traction stresses either at the edges of the surfacing or in the areas which are exposed to a risk of rutting or dislocation.

An embeddable cruciform paving block is known which is the object of a design filed by the Applicants which, with its four equal and slightly flared arms, already sought to satisfy this entirely unprecedented objective.

An embeddable paving block according to the invention is of the type which comprises four identical arms situated at right-angles to one another and which, once the paving blocks have been laid, ensure that the entire surface area is covered. It is characterized in that it has shoulders distributed over the lateral faces and ends of each of these arms. The shoulders are disposed to overlap in the plane of the surfacing of the corresponding shoulders of adjacent paving blocks in order to prevent the plane from opening under the effect of any traction.

According to the invention, the shoulders are disposed in the first half of the faces or lateral half-faces closest to the edges.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
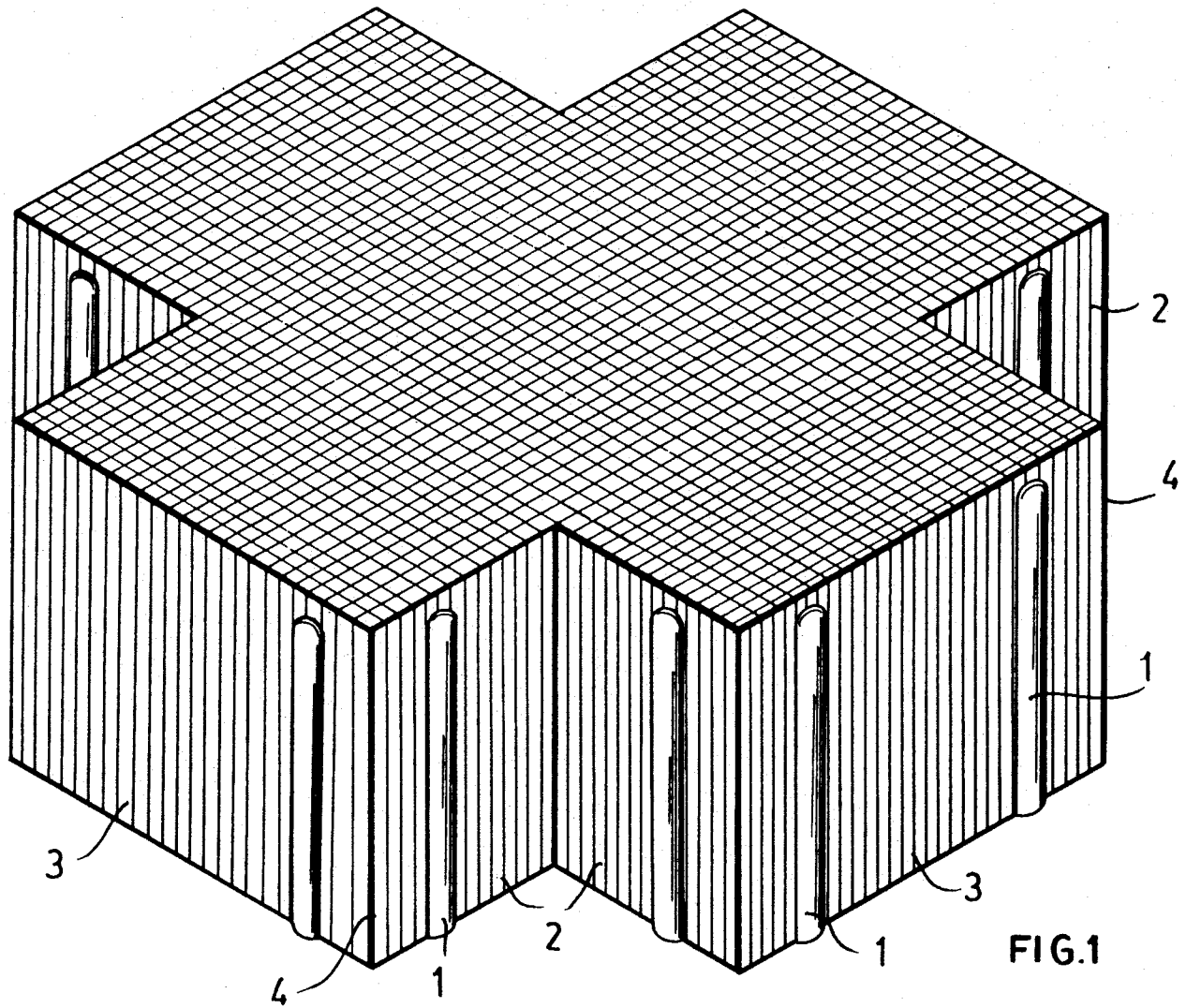
FIG. 1 is a perspective view of an embeddable paving block according to the invention.
Figure 2:
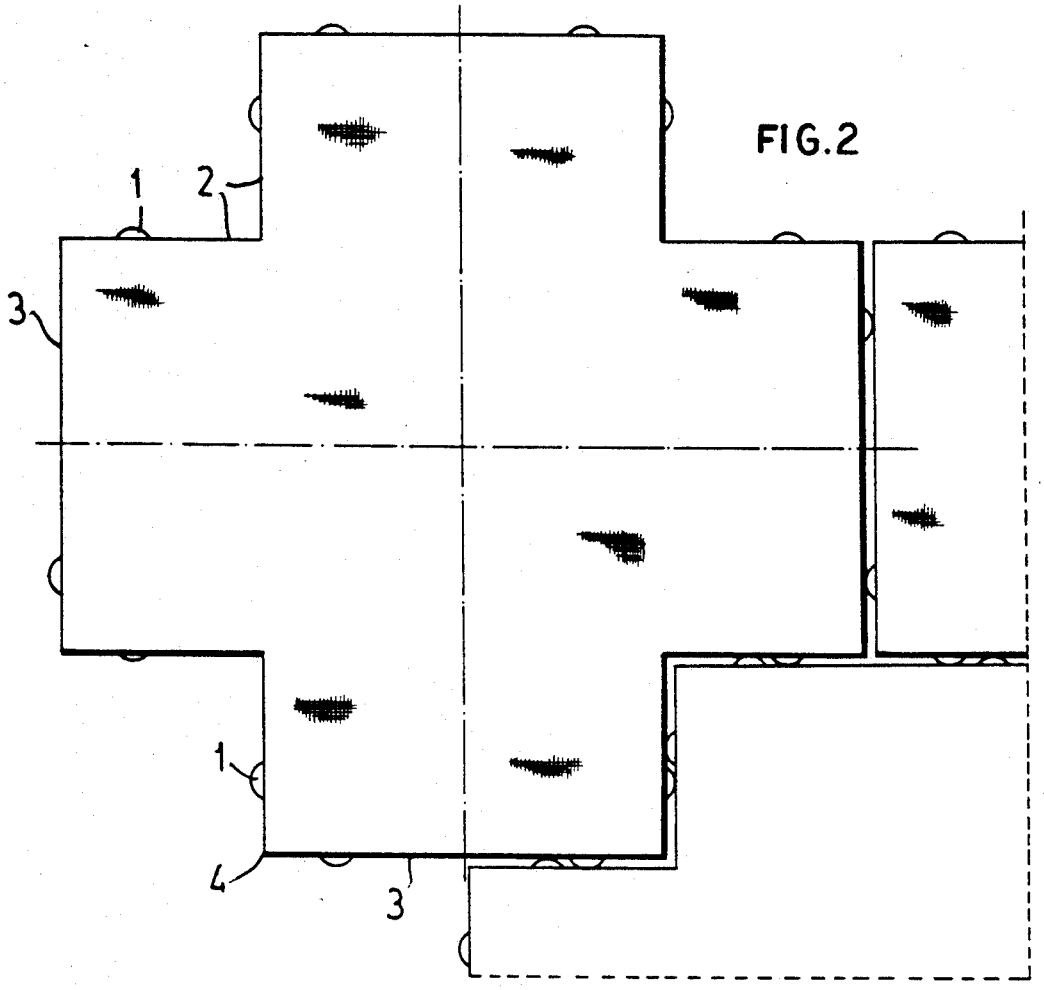
FIG. 2 is a plan view of the block.
Figure 4:
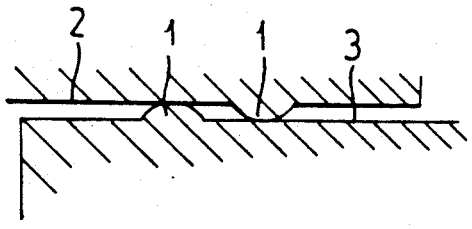
FIG. 4 is a partial section in plan through two adjacent paving blocks detailing the overlapping arrangement.
Figure 3:
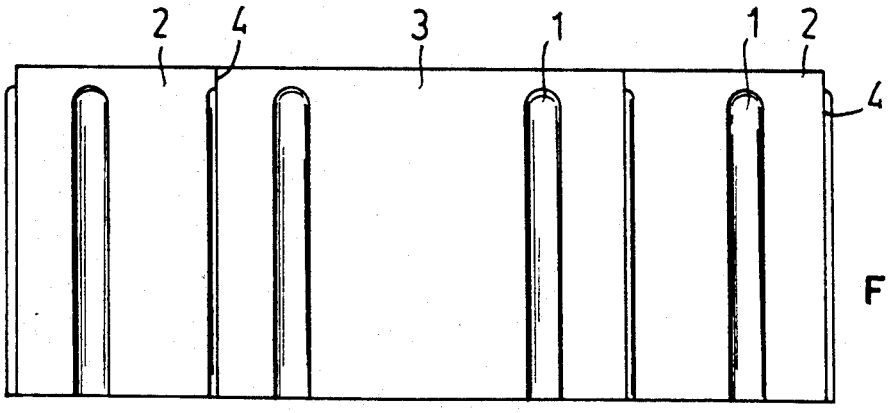
FIG. 3 is a partial elevation of the paving block in FIG. 1.

As FIG. 1 shows, an embeddable paving block according to the invention is of the type which comprises four identical arms which are set at right-angles to form a cross.

On the lateral faces of each arm of the paving block, there are provided shoulders 1. Each of these shoulders 1 consists for example of vertical ribs which project from the faces (FIGS. 1 to 4).

In the paving block illustrated, the arms are twice as wide as they are long. Provided on the small lateral faces 2 is a shoulder but on the ends 3 of the arms are provided either one shoulder or two shoulders for assembly with respectively one end of a paving block adjacent or two small lateral faces of a paving block adjacent.

These shoulders 1 are so disposed that they provide an overlap of the corresponding shoulders of adjacent paving blocks.

The shape and size of the shoulders 1 are indiscriminate in so far as they fulfil their function.

However as is seen in FIGS. 5, 6, 2 and 4 the ribs are spaced apart at a small distance, ensuring an omni-directional inter-engagement which allows the surfacing to withstand a tractive effort, and even flexion in their plane while simultaneously ensuring correct dimensioning of the joints.

According to the invention, it is envisaged that the shoulders should be disposed in the half of the edges closest to the lateral faces or ends which they occupy; that is to say, as can be seen in FIGS. 1 to 4, closer to the free edge 4 of each lateral or end face.

Figure 5:
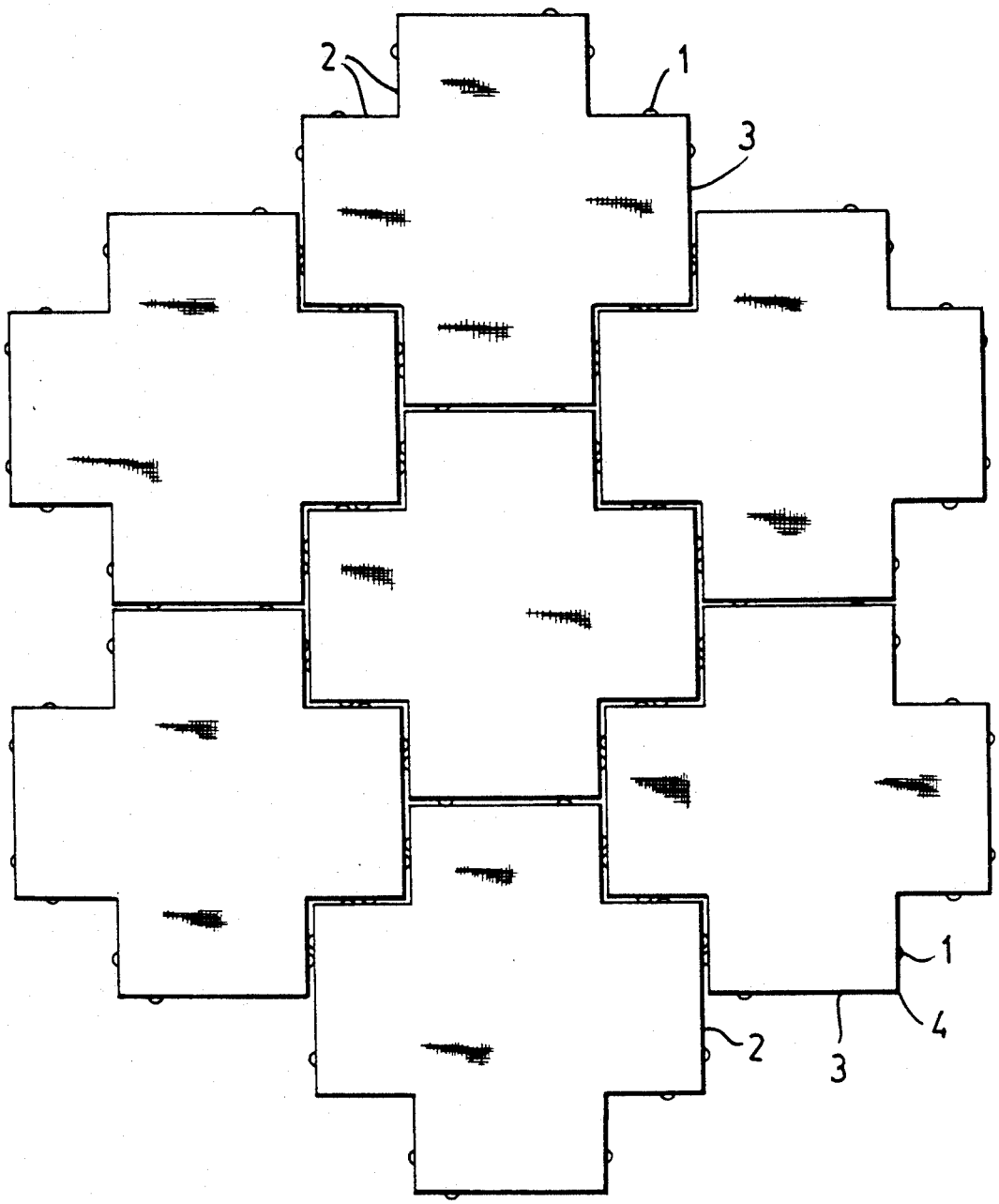
FIGS. 5 to 8 show ways of fitting together the embeddable paving blocks according to the invention.

FIG. 5 shows an assembly of embeddable paving blocks according to the invention with a cruciform appearance.

Figure 6:
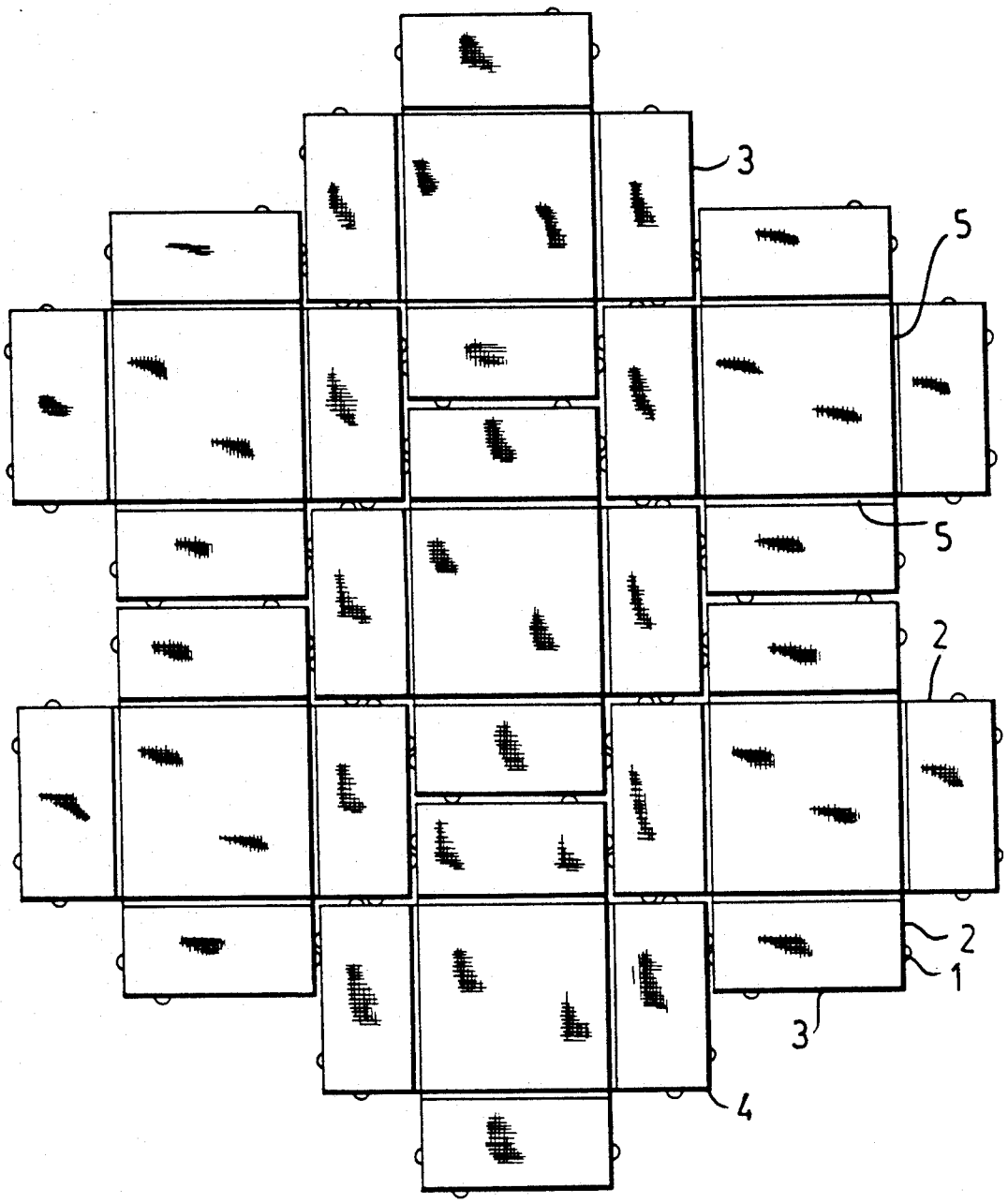
Figure 7:
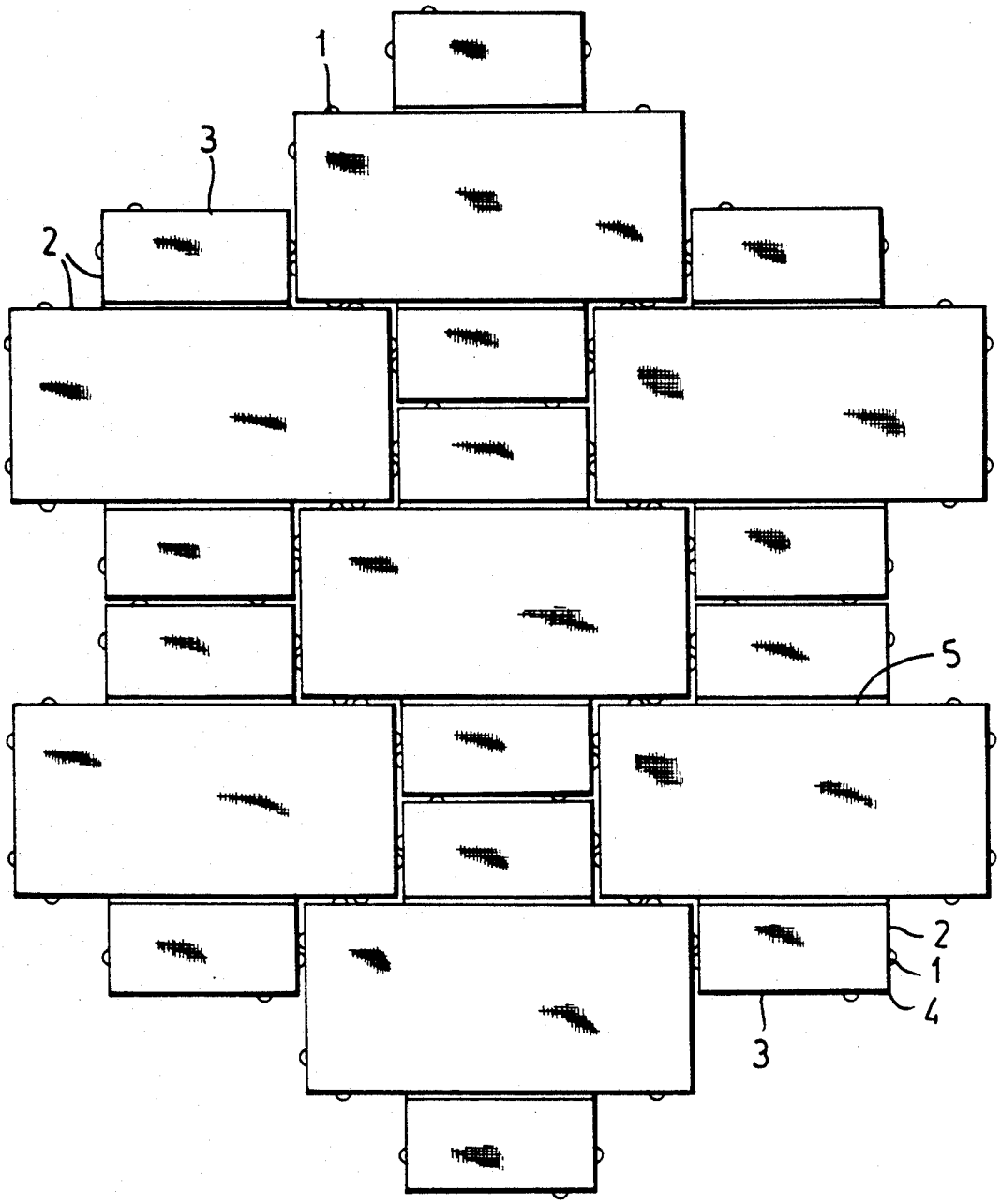
Figure 8:
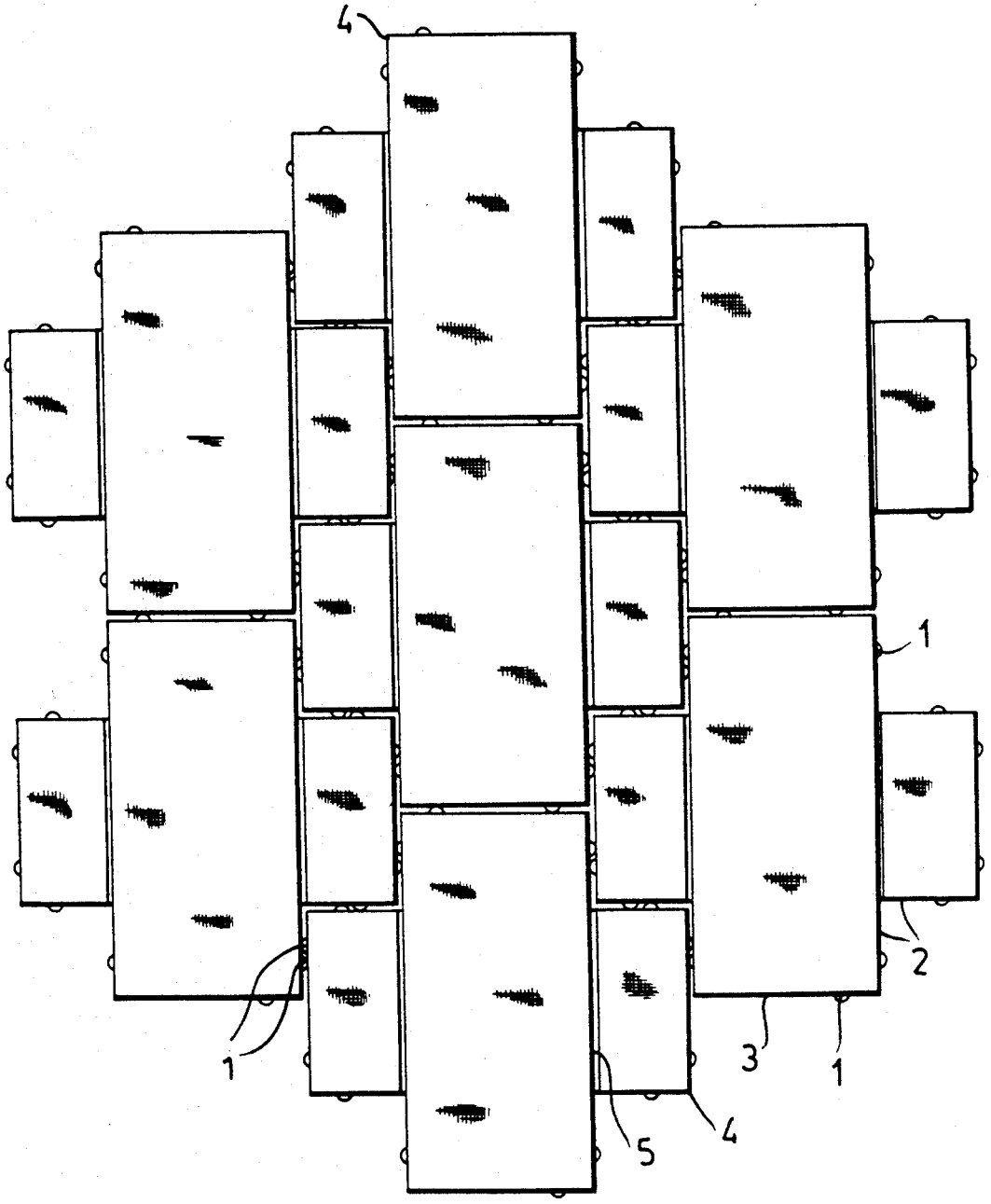

This cruciform appearance although rather archaic, can be masked by a series of false joints 5 imprinted into the visible surface of the paving blocks and giving the surface the appearance of an assembly of squares and/or rectangles (respectively FIGS. 6, 7 and 8).

Of course, the invention may be extended to any formats, colors and materials of paving block capable of providing the desirable resistance and aesthetic appearance. Likewise, the thickness of the joints and therefore of the shoulders, may vary as much as geometry allows, for example in order to ensure water to pass through.

What is claimed is:

1. A paving block adapted for disposition in adjacent relationship to at least one identical block to form a paved surface overlying a surface to be paved, said paving block comprising:

a body having a cruciform shape and centered on a vertical axis, said body being formed with a top surface and a bottom surface and being provided with four rectilinear arms of the same length and width and angularly equispaced about said axis, each of said arms being formed with:

a respective pair of parallel identical lateral faces extending between said top and bottom surfaces, a respective end face bridging the pair of lateral faces and extending between said top and bottom surfaces, said end face meeting said lateral faces along a respective pair of vertical edges, and a plurality of ribs formed on said lateral and end faces and extending substantially parallel to said axis from said bottom surface and terminating short of said top surface, each of said faces being provided with at least one respective rib of said plurality of ribs spaced from a respective one of said vertical edges and protruding from the respective face of one of the paving blocks toward a corresponding face of an adjacent identical block formed with respective ribs so that ribs on the lateral faces of one block abut end faces of another block and said ribs of adjoining faces of said blocks are mutually offset and spaced from one another upon said blocks forming a single surface pattern.

2. The paving block defined in claim 1 wherein each of said end faces is provided with a respective pair of said ribs, each one of said ribs being spaced from a respective one of the vertical edges at a distance substantially less than a distance between said pair of ribs.

3. The paving block defined in claim 1 wherein said top surface is provided with grooves.

4. The paving block defined in claim 1 wherein said end face is twice as wide as each of the lateral faces.

5. The paving block defined in claim 1 wherein the overlapping ribs of corresponding faces of the one and adjacent blocks are spaced apart at a small distance upon forming the surface pattern, each of said ribs being formed of a width greater than said small distance.

* * * * *